US006070371A

United States Patent [19]

Myrick

[11] Patent Number: 6,070,371

[45] Date of Patent: Jun. 6, 2000

[54] LARGE STRUCTURE ENSHROUDER

[76] Inventor: Jim Myrick, 2216 Calle de Castelar, Navarre, Fla. 32566

[21] Appl. No.: 09/192,398

[22] Filed: Nov. 16, 1998

[51] Int. Cl.[7] ..... E04B 1/343

[52] U.S. Cl. ..... 52/63; 52/5; 52/741.3; 52/DIG. 12; 52/29; 52/71; 160/352

[58] Field of Search ..... 52/63, 5, 741.3, 52/DIG. 12, 29, 71; 160/84.01, 352, 56

[56] References Cited

U.S. PATENT DOCUMENTS

| | | | |
|---|---|---|---|
| 3,766,693 | 10/1973 | Richards, Jr. et al. | 52/71 |
| 4,033,367 | 7/1977 | Johnston | 52/63 |
| 5,033,240 | 7/1991 | Richard et al. | 52/63 |
| 5,285,603 | 2/1994 | Richard et al. | 52/63 |
| 5,291,695 | 3/1994 | Heuley et al. . | |

*Primary Examiner*—Christopher T. Kent
*Assistant Examiner*—Dennis L. Dorsey
*Attorney, Agent, or Firm*—Peter Lofflen

[57] ABSTRACT

A large structure enshrouder has a block collector that is secured to the top of the large structure, a plurality of outriggers secured to the top, below the block collector, and a plurality of booms secured to the legs of the large structure. A plurality of first cables are each secured to the shroud, pass through an outrigger, are secured to the block collector and terminate at a collector ring, the collector ring being connected to an appropriate pulling device for lifting the shroud. A plurality of second cables extend between the top and the outrigger for stability of the outrigger, while a plurality of third cables extend between the block collector and the outrigger for further stability. A plurality of fourth cables extend between the booms and the leg of the structure for stability of the booms, the booms also being anchored to the ground. A plurality of fifth cables and sixth cables extend between the outriggers and the booms for stability of the raised shroud during wind load conditions.

14 Claims, 9 Drawing Sheets

12
22
10
T
90
90
88
B

LARGE STRUCTURE ENSHROUDER

BACKGROUND OF THE INVENTION

1. Field of the Invention

The present invention relates to a large structure enshrouder capable of enshrouding a large structure such as a water tank.

2. Background of the Prior Art

When performing substantial work on a large structure such as a water tank, it is often desirable to enshroud the structure. The enshrouding protects the workers and also prevents debris from causing damage to objects below or prevents the debris from being scattered over a large area. Many devices have been proposed to enshroud large structures. U.S. Pat. No. 5,291,695 to Healy et al., U.S. Pat. No. 5,285,603 and U.S. Pat. No. 5,033,240 both to Richard et al., are exemplary of such devices.

While these devices work with varying degrees of success, they are complex in design and construction. Furthermore, they require a relatively large amount of time to install and some are not suited for high wind conditions.

Therefore, there is a need in the art for a large structure enshrouder that overcomes the above-stated limitations. Such an enshrouder must be of relatively simple and straightforward design and construction. Installation and removal of the enshrouder must be relatively quick and the device must accomplish its purpose in a high wind load condition.

SUMMARY OF THE INVENTION

The large structure enshrouder of the present invention addresses the aforementioned needs in the art. The large structure enshrouder is of relatively simple design and construction and is relatively simple to install and remove. The large structure enshrouder of the present invention allows workers to operate on the structure during high wind conditions.

The large structure enshrouder is comprised of a block collector secured to the top of the large structure via a plurality of legs. A plurality of outriggers are secured to the large structure as are a plurality of booms, which are attached to the one or more legs of the large structure. A shroud encompasses the base defined by the large structure, while a plurality of cables are secured to the shroud and are also secured to the block collector, each via a pulley that is secured to a tab on the block collector via a hook hooked onto a clevis attached to a tab. A collector ring, having an aperture-laden plate, a plurality of legs, and a pair of concentric spaced apart rings hold the ends of the first cables. Cables can be used to stabilize the outriggers to the large structure and also to stabilize the booms to the large structure. Anchor screws can also be used to secure the booms to the base. Cables can pass between the outriggers and the booms, on either side of the shroud and thereafter be properly tensioned in order to prevent the shroud from flapping in the wind.

BRIEF DESCRIPTION OF THE DRAWINGS

Similar reference numerals refer to similar parts throughout the several views of the drawings.

DESCRIPTION OF THE PREFERRED EMBODIMENT

Figure 6A:
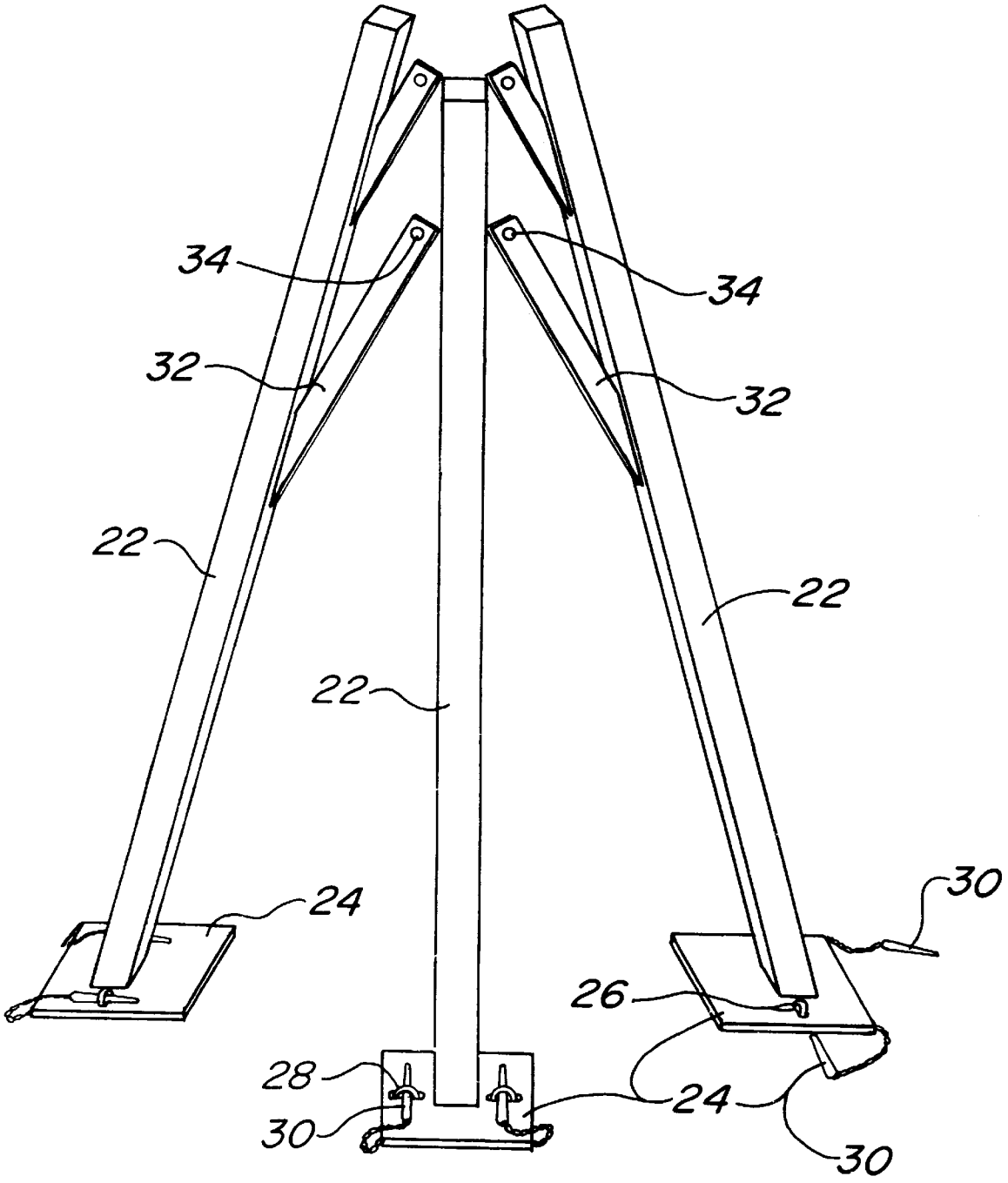
FIG. 6A is a close-up perspective view of the legs used to secure the block collector to the large structure.
Figure 6B:
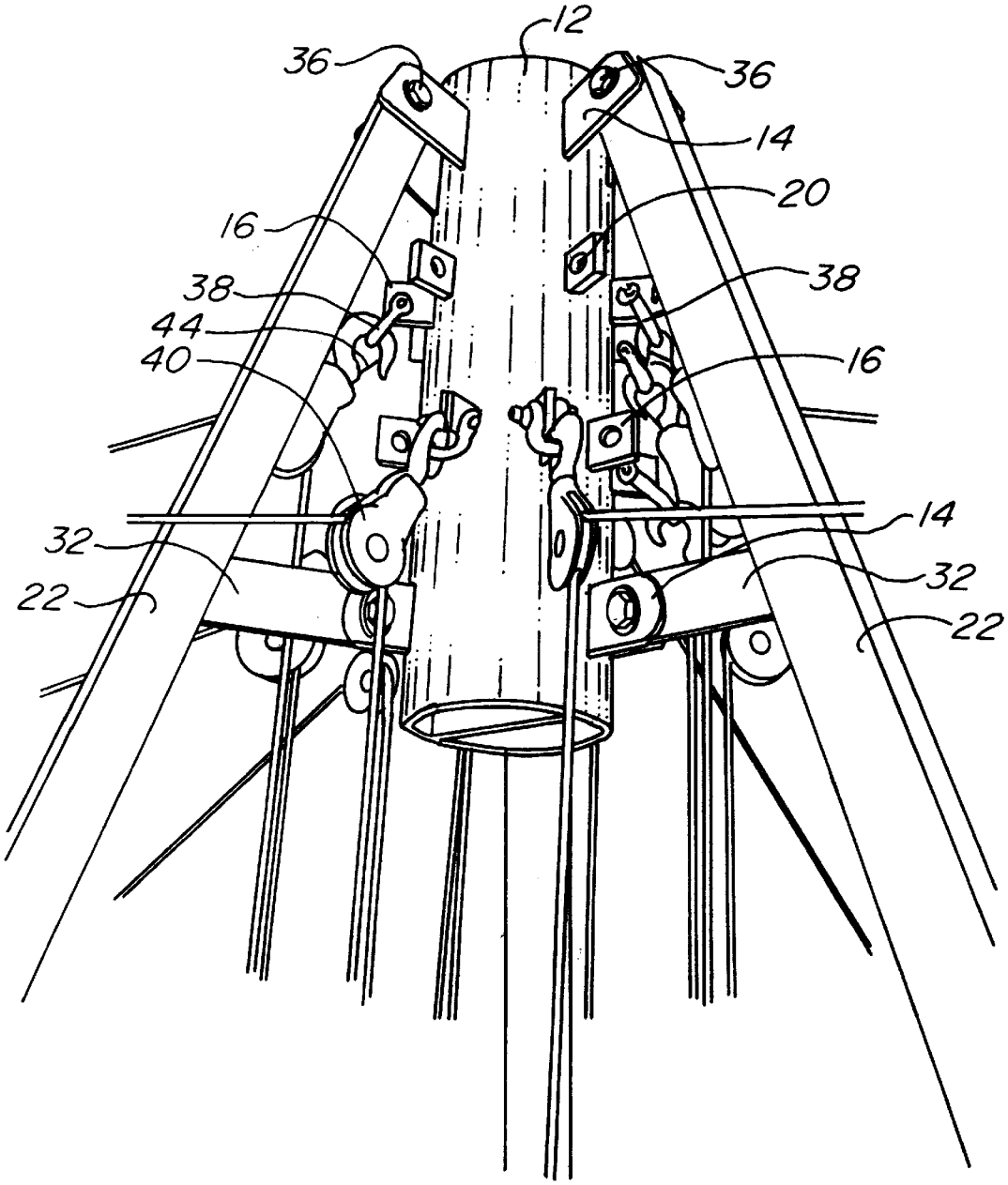
FIG. 6B is a close-up perspective view of the block collector.

Referring now to the drawings, it is seen that the large structure enshrouder of the present invention, generally denoted by reference numeral 10, is comprised of a block collector 12. As seen, the block collector 12 is a generally cylindrical-shaped member having a plurality of first tabs 14 and each of the second tabs 16, each of the first tabs 14 having an aperture 18 and second tabs 16 having an aperture 20 located thereon. A plurality of legs 22 secure the block collector 12 to the top T of a water tank W. As seen in FIGS. 6A and 6B, each leg 22 is secured to a plate 24, the plate 24 having at least one aperture 26 thereon. Eyebolts 28 are secured to the top T of the water tank W and each plate 24 is positioned such that an eyebolt 28 passes through the aperture 26 on the plate 24. The eyebolts 28 can be secured to the top T of the water tank W in appropriate fashion such as by welding. A bull pin 30 is passed through the eyebolt 28 to secure the plate 24 to the top T of the water tank W. Each leg 22 has at least one arm 32 having an aperture 34 such that this aperture 34 is aligned with an aperture 18 of a first tab 14 located on the collector block 12 and a bolt 36 is passed through the aligned apertures 18 and 34 to secure the arm 32 to the block collector 12.

A clevis 38 is secured to the second tabs 16 in appropriate fashion. A pulley 40 having a hook 42 attached thereto, the hook 42 having a safety spring 44, is attached to the clevis 38 via the hook 42.

A bonnet cap 46 is removably securable to the top of the collector block 12. As seen, the bonnet cap 46 has a plurality of tabs 48 located thereon, each tab 48 having an aperture 50. Alternately, a swivel cap 52 can be removably attached to the block collector 12 for lifting items whenever enshrouding is not required.

Figure 7A:
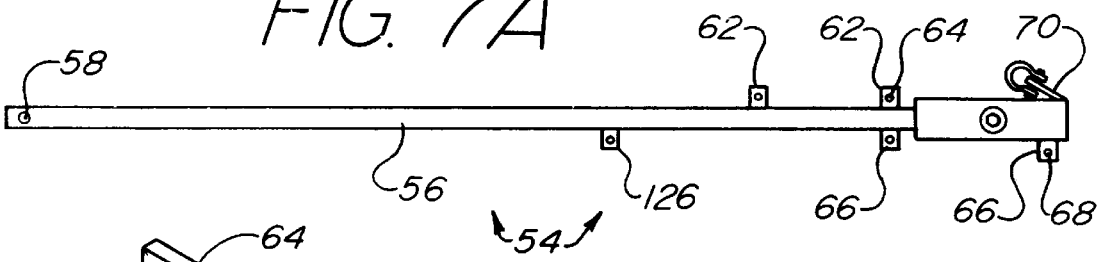
FIG. 7A is a side elevation view of an outrigger used with the large structure enshrouder.
Figure 7B:
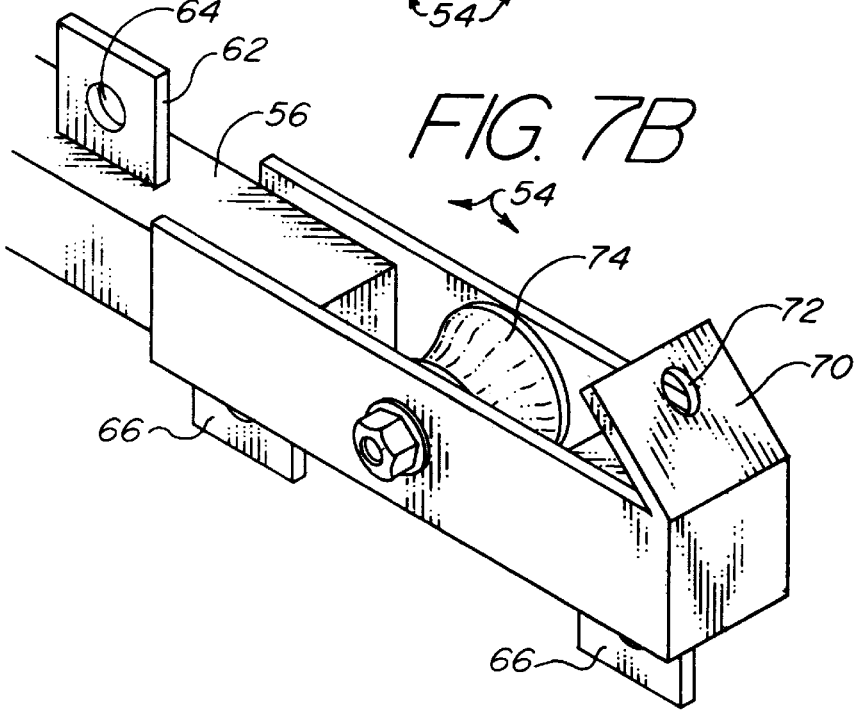
FIG. 7B is a close-up perspective view of a portion of the outrigger.
Figure 8:
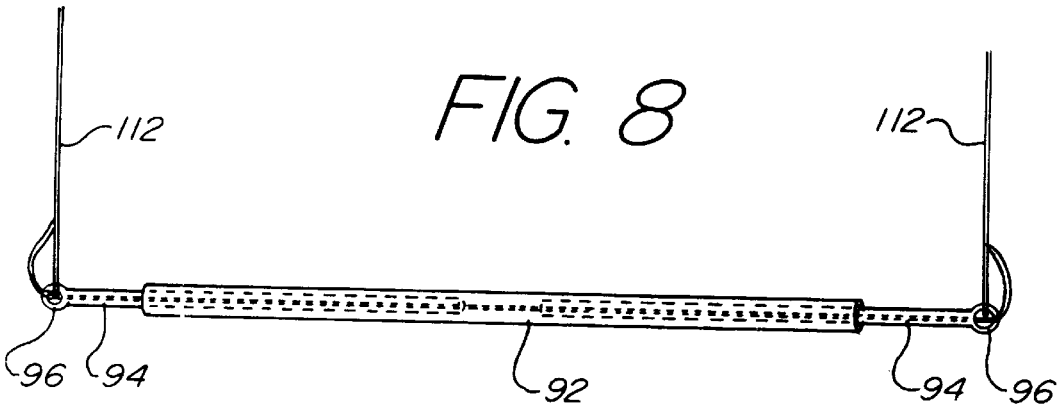
FIG. 8 is a front elevation view of the lifting pipe system used with the large structure enshrouder.

A plurality of outriggers 54 is secured to the outer periphery of the top T of the water tank W. As seen in FIGS. 7A and 7B, the outrigger 54 is comprised of a shaft 56 having an aperture 58 on one end. This aperture 58 is aligned with an aperture (not illustrated) of a tab 60 located on the top T of the water tank W to boltably attach the outrigger 54 to the outer periphery of the top T. Located on the opposing end of the outrigger 54 are a pair of upper tabs 62 each having an aperture 64 and a pair of lower tabs 66 each also having apertures 68. An end tab 70 having an aperture 72 is also located on this end. A roller 74 is rotatably secured to the outrigger 54. An outrigger cable 76 has one end secured to a tab 78 that is secured to the water tank W, passes through one of the apertures 64 of the upper tabs 62, and has an opposing end secured to a tab 78 of the water tank W in spaced apart relation to the first end of the outrigger cable 76. This outrigger cable 76 provides stability to the secured outrigger 54. The tabs 78 may be secured to the water tank W in appropriate fashion such as by welding.

Figure 9:
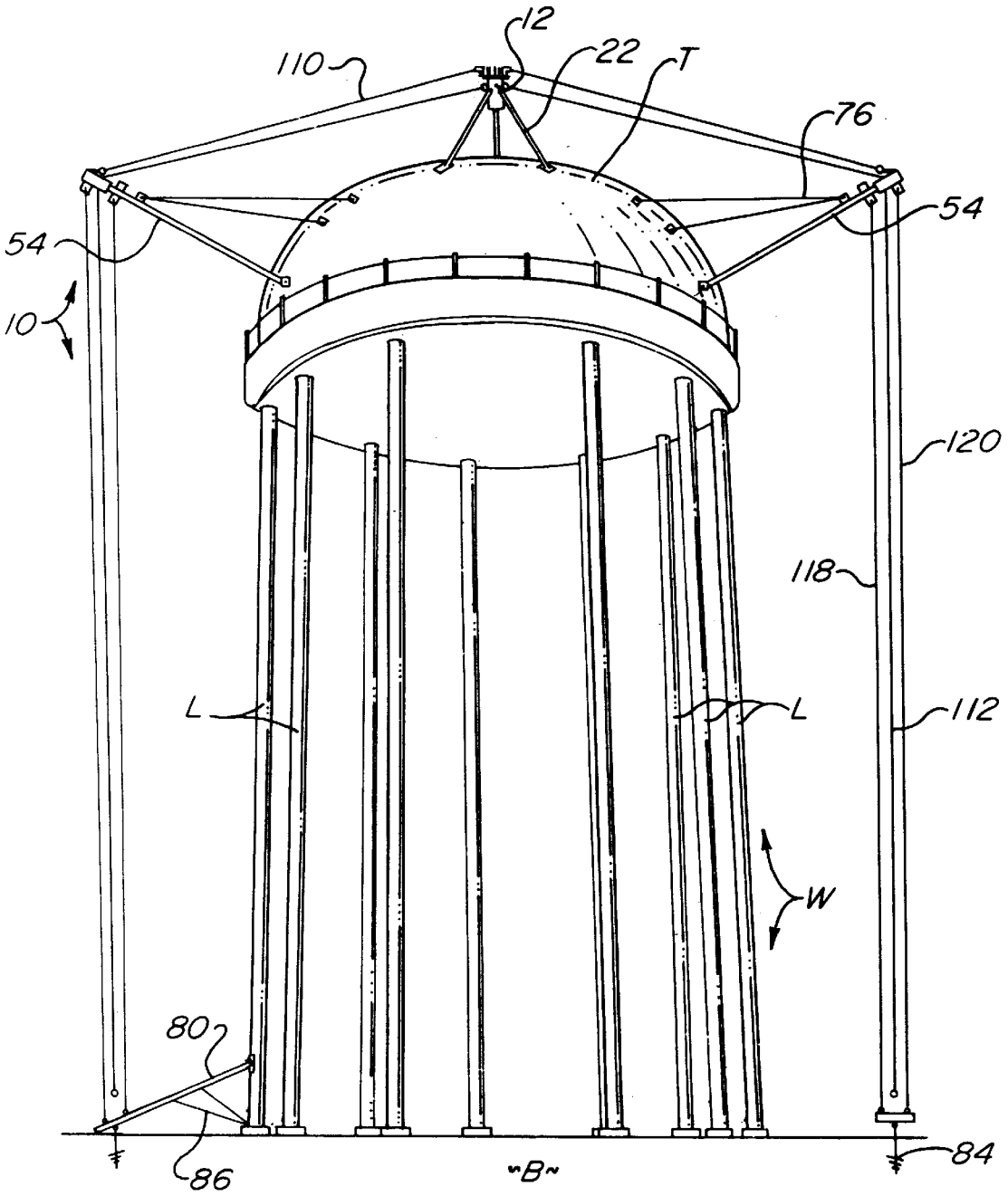
FIG. 9 is a perspective view of the large structure enshrouder covering a single fluted column tank structure.
Figure 10:
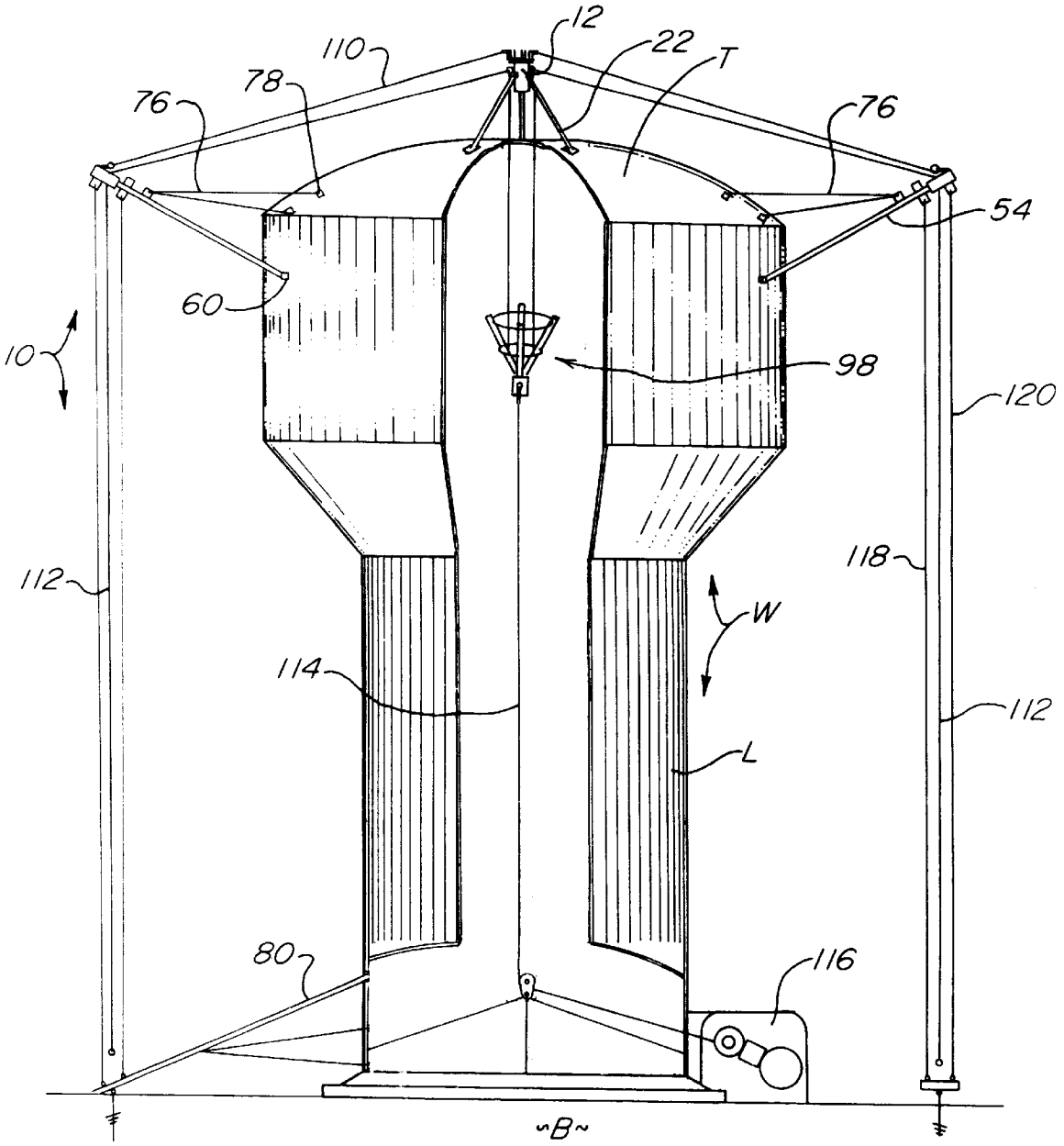
FIG. 10 is a perspective view, partially sectioned, of the large structure enshrouder installed an on elevated tank structure.

A plurality of booms 80 are secured to the at least one leg L of the water tank W. The booms 80 are secured to the legs L in any appropriate fashion such a manner similar to attachment of the outriggers 54 to the top T. As best seen in FIGS. 9 and 10, a pair of upper tabs 82 each having an aperture (not illustrated) are located on the boom 80 while an anchor screw 84 has one end attached to the boom 80 and the opposing end secured within the ground or base B defined by the at least one leg L of the water tank W. A boom cable 86 has one end secured to the boom 80 passes through an aperture of a tab (neither illustrated) located on the leg L and has an opposing end secured to the boom 80 in spaced apart fashion to the first end of the boom cable 86. The two ends of this boom cable 86 can be secured to the boom 80 via aperture-laden tabs (not illustrated) or other appropriate fashion.

A shroud 88 is provided and encircles the water tank W. As seen, the shroud 88 has multiple panels 90 which have support pipes between vertically adjoining panels for structural support of the overall shroud. A lifting pipe 92, having a hollow interior, is secured to each of the uppermost panels 90. A first slide pipe 94, having an aperture 96 on one end, is received within one side of the hollow interior of the lifting pipe 92 while another slide pipe 94, having an aperture 96 on one end, is received within the opposing side of the hollow interior of the lifting pipe 92.

Figure 1:
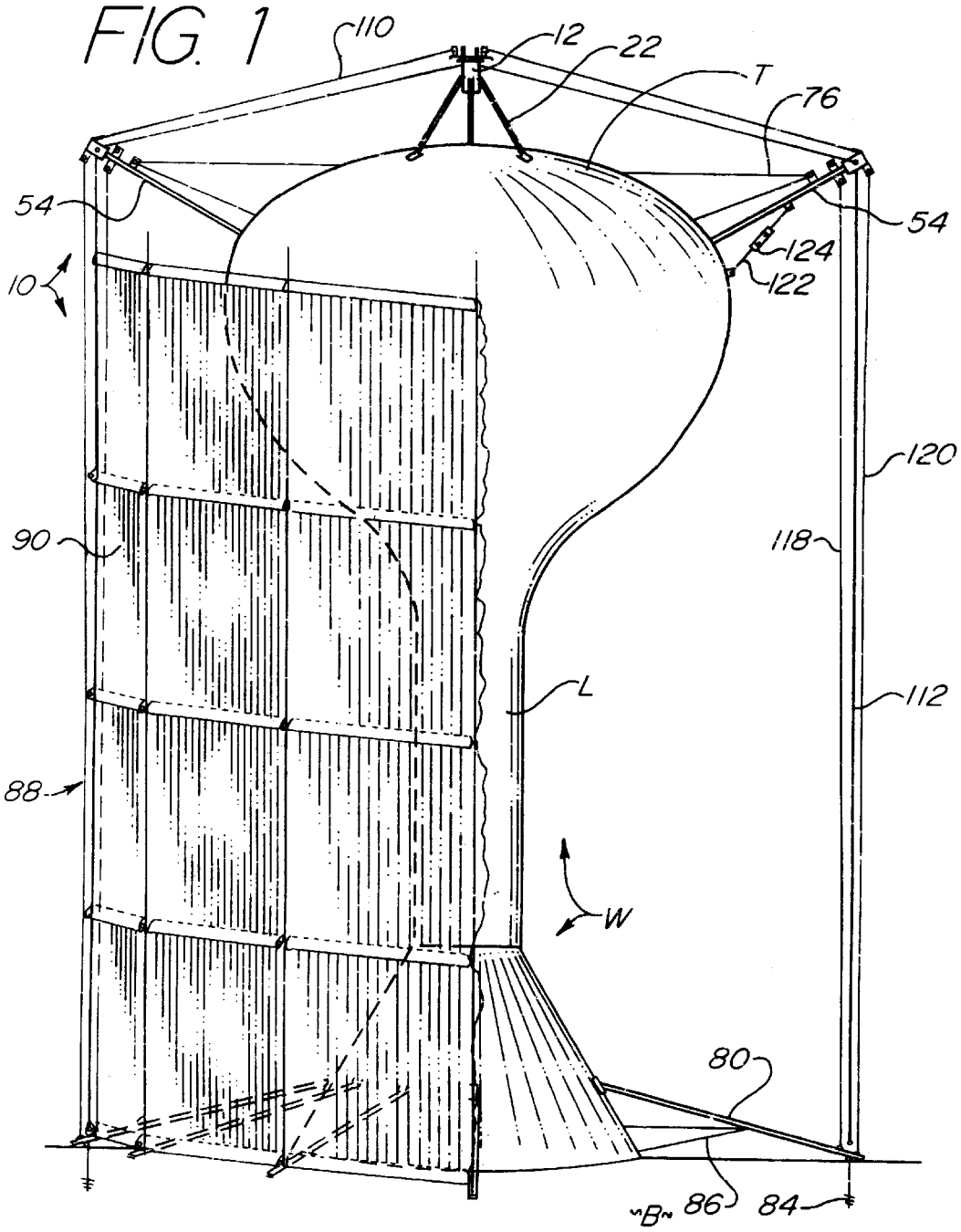
FIG. 1 is a perspective view, partially sectioned, of the large structure enshrouder utilized on a pedestal column spherical tank structure.
Figure 2:
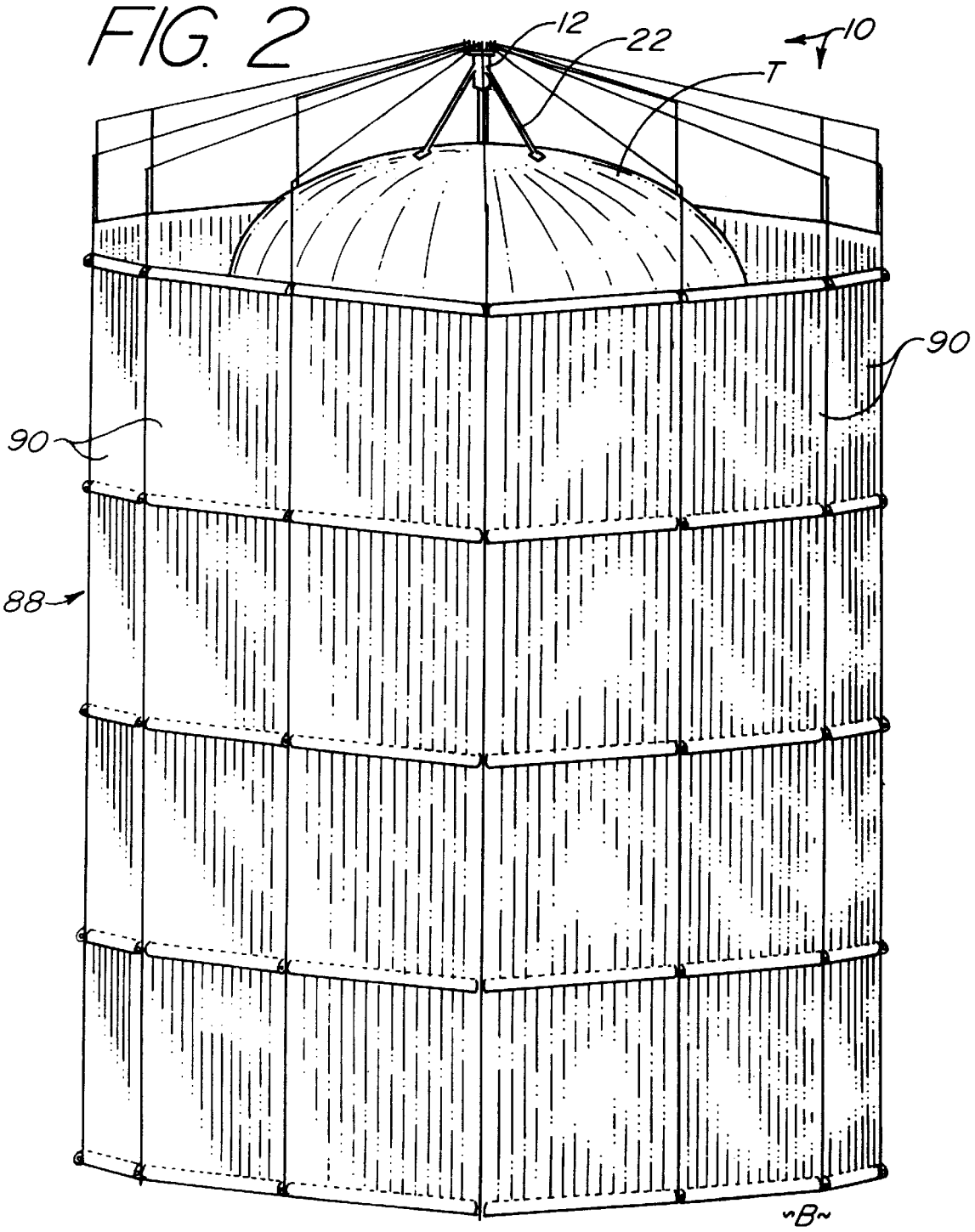
FIG. 2 is a perspective view of the large structure enshrouder utilized on a the pedestal column spherical tank structure.
Figure 3:
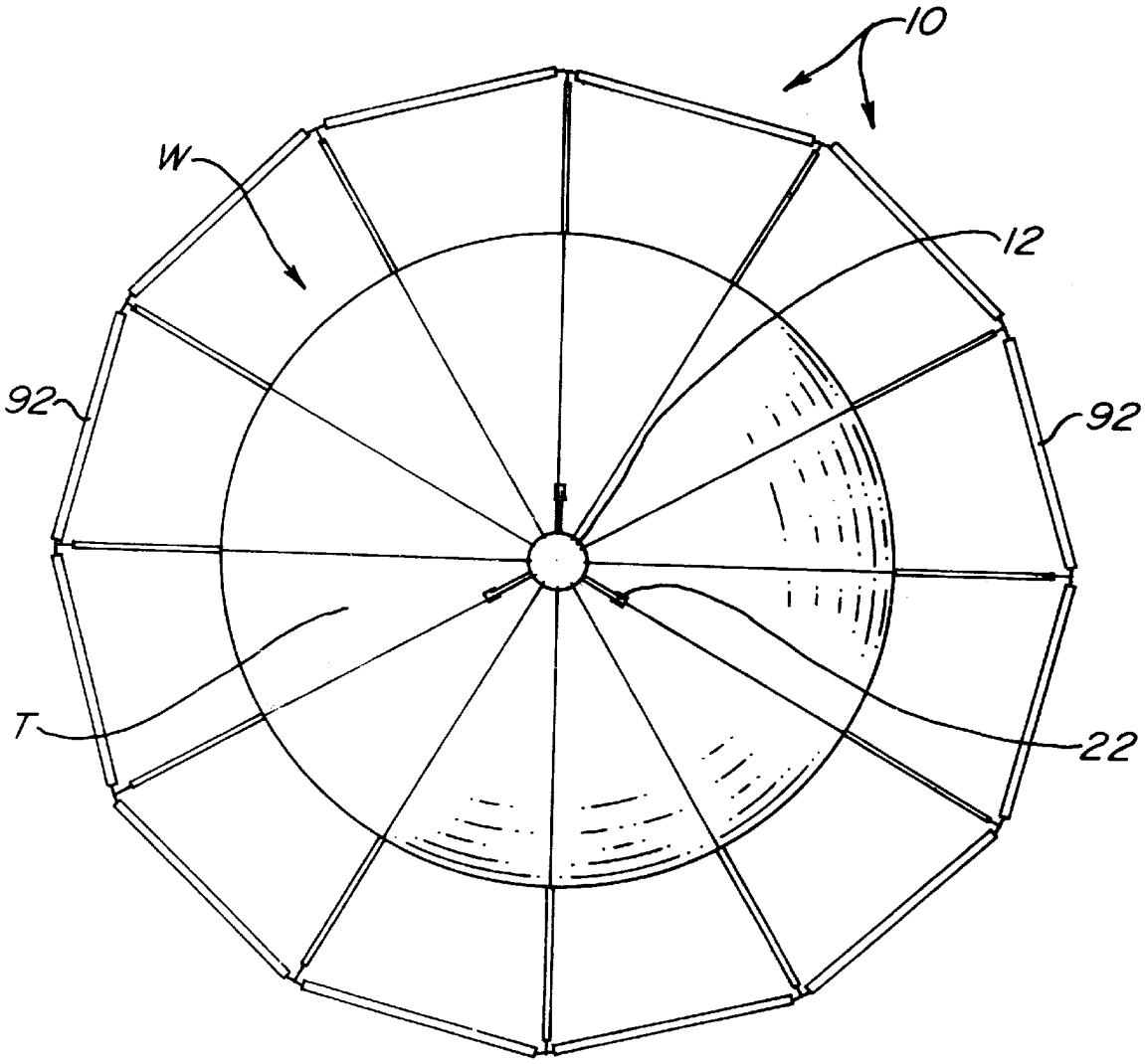
FIG. 3 is a top plan view of FIG. 2.
Figure 4:
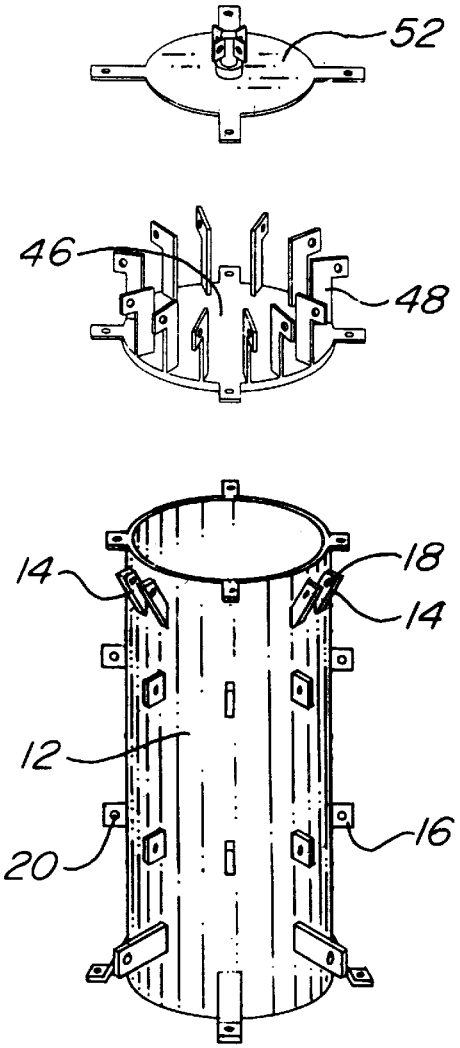
FIG. 4 is a perspective view of the block collector showing both optional caps attachable thereto.
Figure 5:
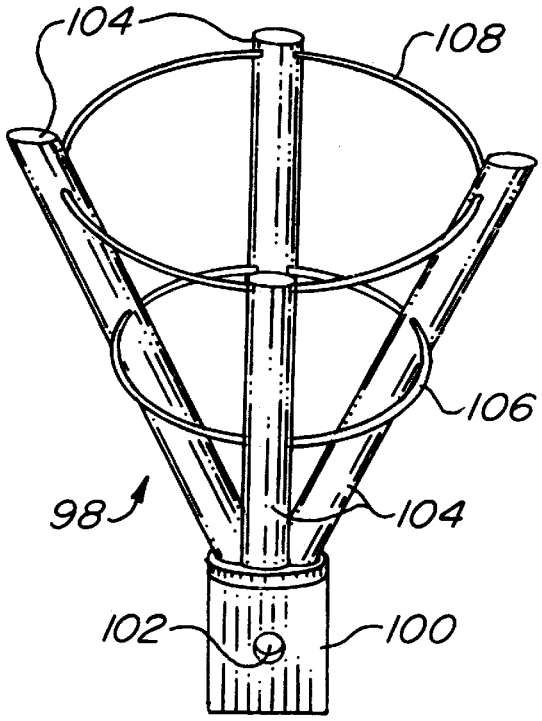
FIG. 5 is a perspective view of the collector ring.

As seen in FIG. 5, a collector ring 98 has a plate 100 with an aperture 102 and a plurality of legs 104 extending therefrom. A first ring 106 is secured to the plurality of legs 104 while a second ring 108 is secured to the plurality of legs 104 in spaced apart fashion to the first ring 106.

In order to utilize the large structure enshrouder 10 of the present invention, the eyebolts 28 are secured to the top T of the water tank W and the legs 22 are positioned such that the apertures 26 of the plates 24 receive the respective eyebolts 28. Bull pins 30 are passed therethrough. Thereafter, the collector block 12 is secured to the legs 22 in appropriate fashion. The bonnet cap 46 is secured to the collector block 12. A plurality of outriggers 54 are secured to the outer periphery of the top T of the water tank W in spaced apart fashion, preferably at equal spacings. The outrigger cables 76 are secured to the top T of the water tank W and the outrigger 54 in appropriate fashion. A bonnet cable 110 has one end secured to the end tab 70 of the outrigger 54 and has the opposing end secured to one of the tabs 48 of the bonnet cap 46. A turnbuckle 124 is secured, via a cable 122 to the water tank W and to a tab 126 located on the outrigger 54. The turnbuckle 124 can be used to adjust overall tensioning of the outrigger 54.

A plurality of booms 80 are secured to the one or more legs L of the water tank W, one boom 80 each located underneath a secured outrigger 54. The anchor screws 84 are used to secure the boom 80 to the base B. Boom cables 86 are secured to the leg L of the water tank W and the boom 80 in appropriate fashion.

The shroud 88 is positioned to encircle the water tank W and rest upon the booms 80. A plurality of pulling cables 112 are provided, each having a first end secured to an aperture 96 of a slide pipe 94. Each pulling cable 112 passes up through the outrigger 54 and passes over the outrigger's roller 74. The pulling cable 112 is received within one of the pulleys 40 attached to the collector block 12. The end of the pulling cable 112 is attached to the first ring 106 of the collector ring 98 in appropriate fashion, such as by being attached to a hook (not illustrated) that hooks onto the first ring 106. The second ring 108 acts as a guide for the pulling cables 112.

Thereafter, a cable 114 is secured to the aperture of the collector ring's plate 100. This cable 114, which passes through the center of the water tank W, is also attached to an appropriate pulling device 116. The pulling device 116 pulls on the collector ring 98 thereby lifting the shroud 88. Once the shroud 88 is at the appropriate elevation, the pulling device 116 stops and an appropriate brake is engaged on the pulling device 116 in order to maintain the shroud 88 in position.

A plurality of first shroud cables 118 extend between the outrigger 54 and the boom 80 between the shroud 88 and the water tank W while a plurality of second shroud cables 120 extend between the outrigger 54 and the boom 80 on the opposite side of the shroud 88 and are appropriately tensioned. These shroud cables 118 and 120 keep the shroud 88 from flapping in a wind condition.

Workers are now free to work on the water tank W as desired.

While the invention has been particularly shown and described with reference to an embodiment thereof, it will be appreciated by those skilled in the art that various changes in form and detail may be made without departing from the spirit and scope of the invention.

I claim:

1. A large structure enshrouder, the large structure having a top with a hollow interior and an outer periphery, and at least one leg defining a base, the large structure enshrouder comprising:

a block collector;

a plurality of outriggers, each having a first end for attachment to the outer periphery and a second end;

a plurality of booms, each having a third end for securement to a respective one of the at least one leg and a fourth end;

a shroud, having a front face and a back face, for encompassing the base; and a plurality of first cables, each first cable having a fifth end secured to a shroud and a sixth end, each of the plurality of first cables passing through a respective one of the plurality of outriggers and secured to the block collector.

2. The large structure enshrouder as in claim 1 further comprising:

a plurality of tabs secured to the block collector;

a plurality of clevis, one each secured to a respective one of the plurality of tabs;

a plurality of pulleys, each receiving a respective one of the plurality of first cables; and a plurality of hooks, one each secured to a respective one of the plurality of first pulleys and secured to a respective one of the plurality of clevis.

3. The large structure enshrouder as in claim 2 further comprising a collector ring for securing to the sixth end of each of the plurality of first cables.

4. The large structure enshrouder as in claim 3 wherein the collector ring comprises:

a plate having an aperture;

a plurality of legs;

a first ring secured to the plurality of legs; and a second ring secured to the plurality of legs in spaced apart relation to the first ring.

5. The large structure enshrouder as in claim 1 further comprising a collector ring for securing to the sixth end of each of the plurality of first cables.

6. The large structure enshrouder as in claim 5 wherein the collector ring comprises:

a plate having an aperture;

a plurality of legs;

a first ring secured to the plurality of legs; and a second ring secured to the plurality of legs in spaced apart relation to the first ring.

7. The large structure enshrouder as in claim 1 further comprising:

a cap secured to the block collector; and a plurality of second cables, each having a seventh end secured to the cap and an eight end secured to a respective one of the plurality of outriggers.

8. The large structure enshrouder as in claim 1 further comprising a plurality of legs, each having a seventh end for securement to the top and an eight end secured to the block collector for securing the block collector to the top.

9. The large structure enshrouder as in claim 1 further comprising a plurality of rollers, each secured to a respective one of the plurality of outriggers such that each of the plurality of first cables passes over a respective one of the pulleys.

10. The large structure enshrouder as in claim 1 further comprising a plurality of second cables, each having a seventh end for securement to the top and an eight end secured to a respective one of the plurality of outriggers.

11. The large structure enshrouder as in claim 1 further comprising a plurality of second cables, each having a seventh end for securement to the top and an eight end secured to a respective one of the plurality of booms.

12. The large structure enshrouder as in claim 1 further comprising:

a plurality of second cables, each having a seventh end secured to a respective one of the plurality of outriggers and an eight end secured to a respective one of the plurality of booms; and a plurality of third cables, each having a ninth end secured to the respective one of the plurality of outriggers and an tenth end secured to the respective one of the plurality of booms.

13. The large structure enshrouder as in claim 1 further comprising a plurality of anchor screws each having a seventh end for securement to a respective one of the booms and an eight end secured within the base.

14. The large structure enshrouder as in claim 1 further comprising:

a plurality of lifting pipes each having a hollow interior and each secured to the shroud; and a plurality of slide pipes, each having a seventh end that is apertured and that receives the sixth end of a respective one of the plurality of first cables and an eighth end that is received within the hollow interior of a respective one of the plurality of the lifting pipes.

* * * * *